US010151101B2

(12) United States Patent
Kähkönen

(10) Patent No.: US 10,151,101 B2
(45) Date of Patent: Dec. 11, 2018

(54) JOINING ELEMENT AND METHOD OF JOINING WOOD STRUCTURES

(71) Applicant: VENONA ARI KÄHKÖNEN, Loviisa (FI)

(72) Inventor: Ari Kähkönen, Loviisa (FI)

(73) Assignee: VENONA ARI KÄHKÖNEN, Loviisa (FI)

( * ) Notice: Subject to any disclaimer, the term of this patent is extended or adjusted under 35 U.S.C. 154(b) by 37 days.

(21) Appl. No.: 15/036,006

(22) PCT Filed: Nov. 11, 2014

(86) PCT No.: PCT/FI2014/050849

§ 371 (c)(1),
(2) Date: May 11, 2016

(87) PCT Pub. No.: WO2015/071539

PCT Pub. Date: May 21, 2015

(65) Prior Publication Data

US 2016/0289950 A1 Oct. 6, 2016

(30) Foreign Application Priority Data

Nov. 14, 2013 (FI) ..... 20136116

(51) Int. Cl.
*E04B 1/26* (2006.01)
*E04B 1/48* (2006.01)

(52) U.S. Cl.
CPC ..... *E04B 1/2604* (2013.01); *E04B 1/486* (2013.01); *A47B 2230/0059* (2013.01); *E04B 2001/264* (2013.01); *E04B 2001/2648* (2013.01); *Y10T 428/192* (2015.01)

(58) Field of Classification Search
CPC ..... Y10T 428/192; Y10T 403/553; A47B 2230/0059; A47B 2230/0029; A47B 2230/0037; A47B 2230/0004; F16B 5/002; F16B 5/0088; F16B 5/0024
See application file for complete search history.

(56) References Cited

U.S. PATENT DOCUMENTS

| | | | |
|---|---|---|---|
| 4,870,797 | A | 10/1989 | Hagemeyer |
| 2003/0016992 | A1 | 1/2003 | Layfield |

FOREIGN PATENT DOCUMENTS

| | | | |
|---|---|---|---|
| CH | 339735 | A | 7/1959 |
| DE | 86 31 926.4 | U1 | 1/1987 |
| EP | 1 630 427 | A1 | 3/2006 |
| JP | 11-36447 | A | 2/1999 |
| SU | 1165755 | A | 7/1985 |
| WO | WO 98/52728 | A2 | 11/1998 |

OTHER PUBLICATIONS

Machine translation of CH339735 retrieved Dec. 6, 2017.*
Extended European Search Report dated May 18, 2017, for European Application No. 14861545.3.

* cited by examiner

*Primary Examiner* — Alexander S Thomas
(74) *Attorney, Agent, or Firm* — Birch, Stewart, Kolasch & Birch, LLP

(57) ABSTRACT

A joining element includes at least two joint holes for pin joints as well as a first plane surface and a second plane surface and an inclined surface slanting towards an outer edge of the joining element and arranged at an angle with respect to at least one said plane surface. A method includes joining two wood structures to one another by using the joining element.

13 Claims, 3 Drawing Sheets

JOINING ELEMENT AND METHOD OF JOINING WOOD STRUCTURES

BACKGROUND

The invention relates to wood structures, and particularly to a joining element and a method of joining wood structures.

In log construction and in wood construction, it is typical to use various metal plates, such as perforated metal plates, angle irons or the like, fastened to the outer surface of a wood surface in order to join log and/or wood structures. Such solutions are problematic not only because of the appearance of the joint but often also because of the weakness thereof.

In glued beam construction, when forming so-called beam frame solutions, again, the pieces of the frame are usually joined by notching. However, the process of notching is laborious and expensive, and usually has to be carried out in an industrial environment since, typically, notching requires large machine tools unavailable at ordinary construction sites.

A further solution in connection with furniture structures in particular is known wherein wood or fibre plates are joined to one another by cutting a dimensionally accurate groove in both pieces to be joined and by fitting in the groove a connecting block to join the pieces to one another by means of either glue or form locking. However, as far as heavier and more demanding tasks, such as house building, are concerned, such solutions are not capable of providing a sufficiently strong joint; furthermore, special tools are required for forming the grooves required by such a connecting block.

BRIEF DESCRIPTION OF THE INVENTION

An object of the invention is thus to provide a novel joining element and method of joining wood structures. The object of the invention is achieved by a joining element and a method which are characterized by what is stated in the independent claims. Preferred embodiments of the invention are disclosed in the dependent claims.

The solution is based on joining wood structures to one another by employing a joining element arrangeable in a groove provided in the pieces to be joined. The groove and the joining element are formed so as to enable both glue and pin joints to be used in the joint.

An advantage of the joining element and method according to the solution is that it enables a joint to be formed which enables large wood parts to be joined quickly to one another and which is strong and immediately sufficiently stiff so as to allow installation work to be continued. The strength and firmness of the joint are also enhanced by forming the joint from a plurality of support points between the joining element and the joint groove provided in the materials to be joined. A further advantage is that the groove may be formed in the pieces to be joined at the site of use.

BRIEF DESCRIPTION OF THE FIGURES

The invention is now described in closer detail in connection with preferred embodiments and with reference to the accompanying drawings, in which.

DETAILED DESCRIPTION

The figures are schematic and only intended to illustrate the solution and some of its embodiments. For the sake of clarity, only some of mutually similar features of the solution are numbered in the figures.

Figure 1A:
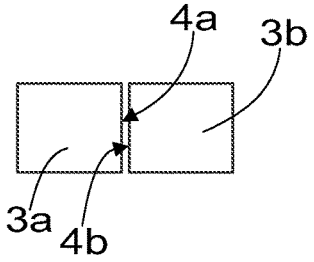
FIGS. 1*a*, 1*b*, and 1*c* schematically show some wood structure joints.
Figure 1B:
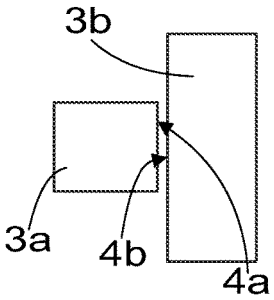
Figure 1C:
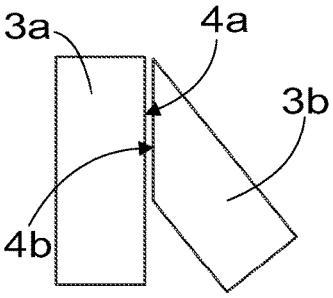

FIGS. 1*a*, 1*b*, and 1*c* schematically show some wood structure joints. In these wood structure joints, two wood structures 3*a*, 3*b* are joined to one another such that joining surfaces 4*a*, 4*b* of the wood structures are arranged to face one another. FIGS. 1*a* to 1*c* show only some examples of joining wood structures, and in different embodiments more than two wood structures may be joined to one another, the wood structures may join to one another at any side thereof, and they may be arranged at any angle with respect to one another. For the sake of clarity, the wood structures 3*a*, 3*b* are arranged at a small distance from one another in the figures.

Figure 2:
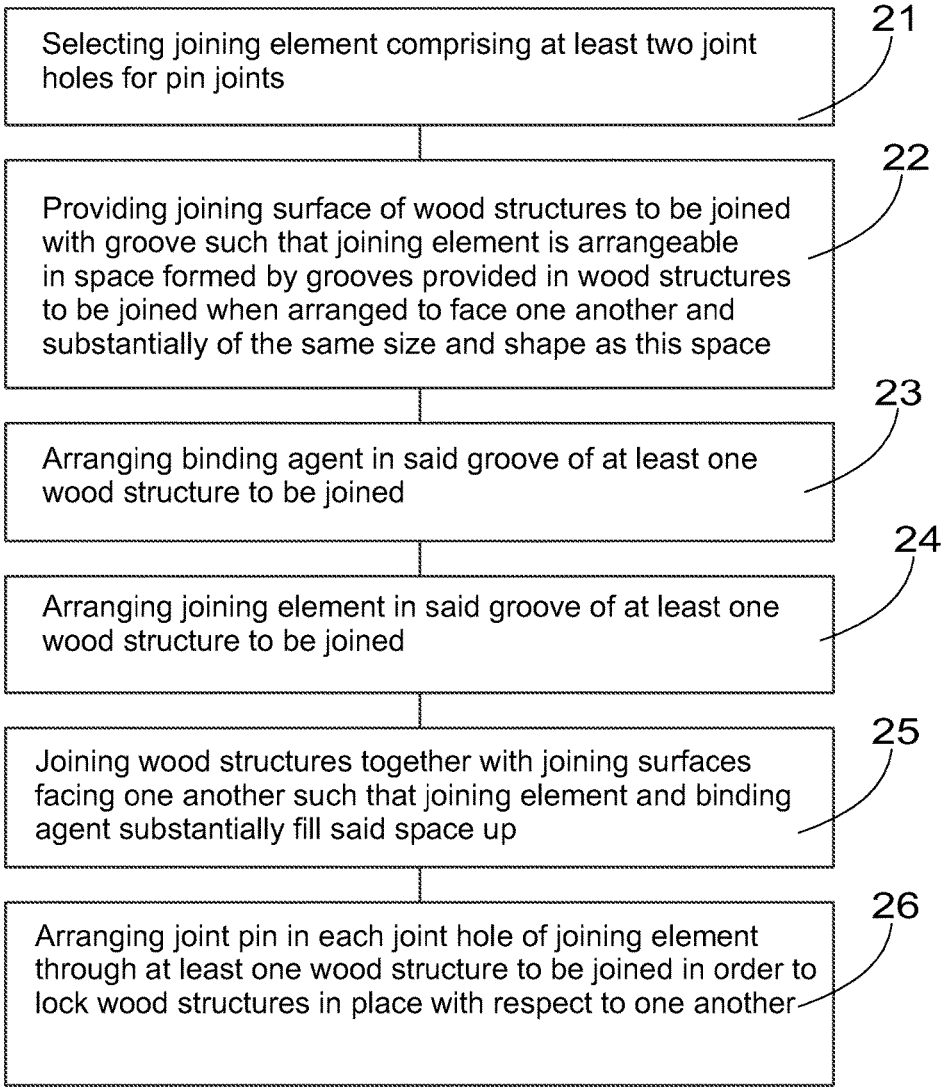
FIG. 2 shows a method of joining wood structures.

FIG. 2 shows a method of joining wood structures. The method comprises selecting 21 a joining element 1 comprising at least two joint holes 2 for pin joints. Preferably, the joining element 1 may further comprise a first plane surface 7*a* and a second plane surface 7*b* and an inclined surface 9*a*, 9*b* slanting towards an outer edge 8 of the joining element and arranged at an angle with respect to at least one plane surface 7*a*, 7*b*, the joining element 1 being at least at one of its outer edges 8 or in one area of its outer edge in a direction of the joint holes 2 more tapered than in an area of a middle part of the joining element. The direction of the joint holes 2 refers to a direction of the longitudinal axes of the joint holes 2. Preferably, the joining element 1 may thus be more tapered at least at one of its outer edges 8 or in one area of the outer edge in the area of the middle part of the joining element. In an embodiment, the joining element 1 may be in accordance with any other joining element disclosed in this description. In yet another embodiment, the present method of joining wood structures may also employ a joining element 1 of another kind suitable for the method.

The joining surface 4*a*, 4*b* of each wood structure 3*a*, 3*b* to be joined is provided 22 with a groove 5*a*, 5*b* such that the joining element 1 is arrangeable in a space formed by the grooves provided in the wood structures to be joined in between the wood structures when the wood structures are placed against one another with the joining surfaces of the wood structures facing one another. The shape of the space is substantially congruent, i.e. of the same size and shape as the joining element.

Further, the method of FIG. 2 comprises arranging 23 a binding agent in the groove 5*a*, 5*b* of at least one wood structure 3*a*, 3*b* to be joined, arranging 24 the joining element 1 in the groove 5*a*, 5*b* of at least one wood structure to be joined, and joining 25 the wood structures 3*a*, 3*b* to one another with the joining surfaces 4*a*, 4*b* facing one another, such that the joining element 1 and the binding agent substantially fill the space up. Next, the method may comprise arranging 26 a joint pin 6 in each joint hole of the joining element 1 through at least one wood structure 3*a*, 3*b* to be joined in order to lock the wood structures in place with respect to one another. This enables a strong joint to be formed between the wood structures.

In an embodiment, the joining element comprises a first curved part and a second curved part at mutually opposite ends. Similarly, each wood structure to be joined may be provided with a groove having a shape substantially in conformity with that of the first or the second curved part. This is particularly advantageous since it is possible to form such a groove by a suitable blade arrangeable in a tool readily available at an ordinary worksite, preferably a tool with a rotating blade, such as a circular hand saw or the like. Preferably, the grooves may then be formed as so-called insert embedding. This enables the wood structures to be joined at the construction site without any large machine tools and/or other special tools or necessary preceding factory work phases. A suitable blade may preferably be a blade which is particularly designed for the purpose and which enables a groove having a shape in accurate conformity with a segment of the joining element, for instance a half of the joining element, to be readily formed in the wood structure to be joined. On the other hand, the present joining element 1 and method for joining wood structures are naturally also highly suitable for use in factory work or similar industrial environment and/or in factory work phases associated with wood construction and wood structures.

In an embodiment, the binding agent may comprise a glue known per se and suitable for joining wood materials, particularly preferably a polyurethane glue. The glue enables the joining element and the wood structures to be joined to be bound immovably to one another. A polyurethane glue also expands in the joint, filling up a possible gap caused by dimensional tolerances between the joining element and the wood structures to be joined and binding the joining element and the wood structures to one another, thus forming a substantially uniform structure, which is particularly preferable as far as the strength of the joint is concerned.

Figure 3A:
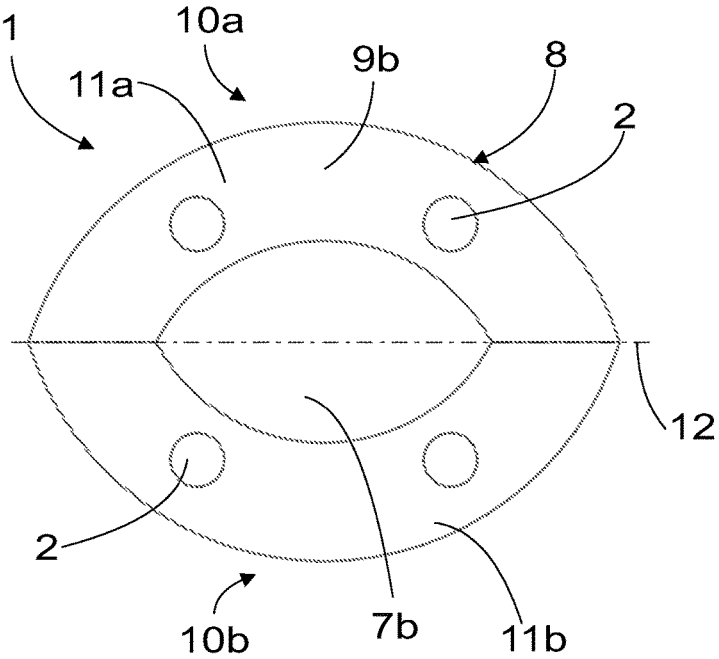
FIGS. 3*a* and 3*b* show a joining element for joining wood structures to one another.
Figure 3B:
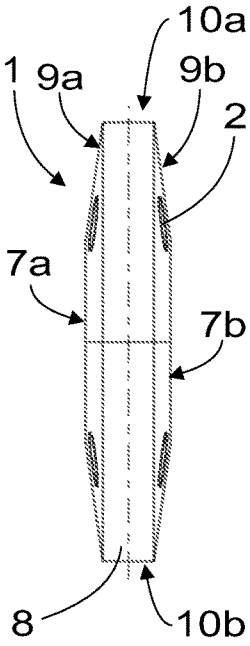

FIGS. 3*a* and 3*b* show a joining element for joining wood structures to one another. FIG. 3*a* is a front view of the joining element 1 while FIG. 3*b* is a side view of the joining element. The joining element then comprises at least two joint holes 2 for pin joints as well as a first plane surface 7*a* and a second plane surface 7*b* and an inclined surface 9*a*, 9*b* slanting towards the outer edge 8 of the joining element 1 and arranged at an angle with respect to at least one plane surface 7*a*, 7*b*. Thus, the joining element 1 is then at least at one of its outer edges or in one area of its outer edge in the direction of the joint holes 2 more tapered than in the area of the middle part of the joining element 1, as can be seen in FIG. 3*b* in particular. Owing to such a wedge-like structure of the joining element, the joining element and the wood structures to be joined settle with respect to one another into an intended position in all three directions/dimensions and press tightly and substantially immovably into one another.

In an embodiment, the first plane surface 7*a* and the second plane surface 7*b* are arranged on opposite sides of the joining element 1 and are mutually substantially parallel, as in the embodiment of FIGS. 3*a* and 3*b*. An advantage of this solution is that the joining element and the wood structures to be joined may be supported against one another substantially over the entire area of these plane surfaces, which adjusts the wood structures to be joined accurately into the desired position and makes the joint stronger.

In an embodiment, the joining element comprises a first curved part 11*a* at a first end 10*a* of the joining element, and a second curved part 11*b* at a second end 10*b* of the joining element, which resides at an end opposite to the first end 10*a* of the joining element.

Upon joining the wood structures, the first end 10*a* thus settles in the groove 5*a* of the first wood structure 3*a* while the second end 10*b* settles in the groove 5*b* of the second wood structure 3*b*, the joining element thus settling in the space formed by these grooves 5*a*, 5*b* between the wood structures when the wood structures have been arranged against one another, as can also be seen in the figures. Preferably, the joining element 1 may be substantially symmetrical, i.e. the first end 10*a* and the second end 10*b* may be congruent in shape but antiparallel, in which case the grooves 5*a*, 5*b* may also have mutually substantially the same shape. In such a case, the joining element 1 may be arranged between the wood structures 3*a*, 3*b* to be joined such that a centre line 12 situated between the first end 10*a* and the second end 10*b* of the joining element 1 and designated in broken line in FIG. 3*a* is arranged substantially parallel with the joining surfaces 4*a*, 4*b* of the wood structures 3*a*, 3*b* to be joined, i.e. the centre line 12 of the joining element 1 settles in the wood structure joint substantially parallelly with the joining line of the wood structures.

In an embodiment, the joining element 1 is symmetrical in cross-section such that it comprises mutually substantially parallel first and second plane surfaces 7*a*, 7*b* as well as on both sides of the joining element, at least at the first and the second end 10*a*, 10*b* of the joining element, inclined surfaces 9*a*, 9*b* slanting from these plane surfaces towards the outer edge 8 of the joining element, the joining element being at the first end 10*a* and at the second end 10*b* in the direction of the joint holes more tapered than in the middle area of the joining element defined by the first and the second plane surface 7*a*, 7*b*.

In an embodiment, the joining element is formed from a wood material. This is preferable as far as both the uniform appearance to be achieved and also the uniform properties of the material are concerned. All components of the joint, i.e. the wood structures 3*a*, 3*b* to be joined and the joining element 1, are then provided with identical gluing properties, for instance, which is why, for instance, the same binding agent is suitable for all the components of the joint and forms a substantially equally strong joint therewith. Then, too, material alterations taking place due to the influence of heat and moisture, such as expansion, are substantially the same to all components of the joint. Particularly preferably the joining element may be formed from a cross-glued wood material, which is particularly strong under shear and torsional stress.

In an embodiment, the joint pin 6 may be formed from the same material as at least one of the wood structures to be joined. An advantage of this solution is that the wood structure joint looks as uniform as possible on the outside.

Figure 4A:
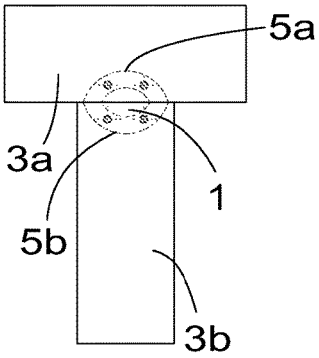
FIGS. 4*a*, 4*b*, and 4*c* schematically show a wood structure joint.
Figure 4B:
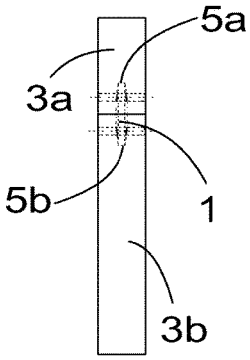
Figure 4C:
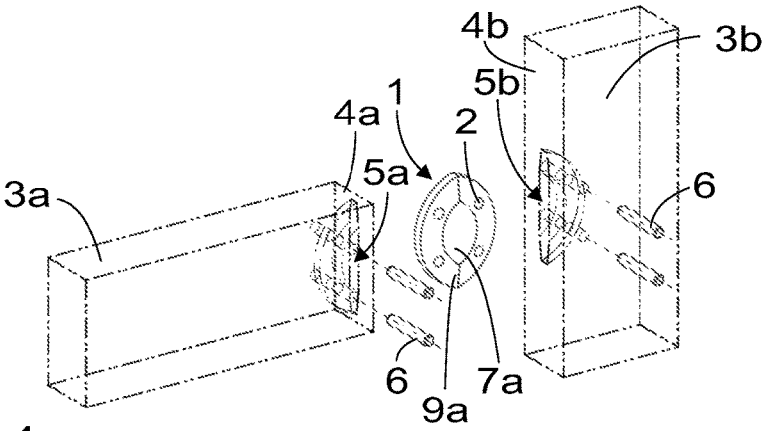

FIGS. 4*a*, 4*b*, and 4*c* schematically show a wood structure joint in which the first wood structure 3*a* and the second wood structure 3*b* are joined to one another by a joint structure comprising a joining element 1, grooves 5*a*, 5*b* arranged in the first and the second wood structure as well as joint pins 6 arranged in joint holes of the joining element. FIG. 4*a* is a front view of the wood structure joint, FIG. 4*b* is a side view thereof, and FIG. 4*c* is an exploded view in perspective of the components of the wood structure joint. The joining element 1 may be according to any one of the embodiments of the joining element disclosed above. Preferably, in the joint structure, a binding agent may be arranged between the joining element and the wood structures to be joined to make the joint between the joining element and the groove provided in the wood structure stronger. This binding agent may preferably comprise for instance a glue known per se, particularly preferably a polyurethane glue.

Figure 5A:
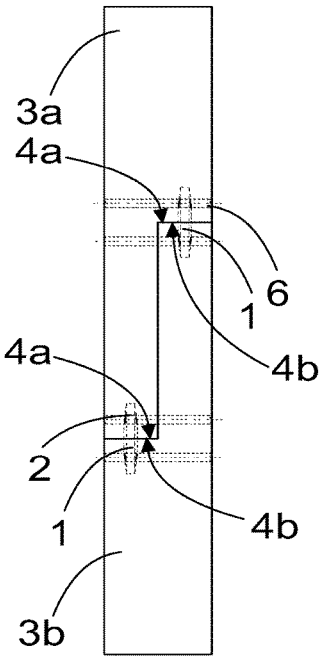
FIGS. 5*a* and 5*b* schematically show some other wood structure joints.
Figure 5B:
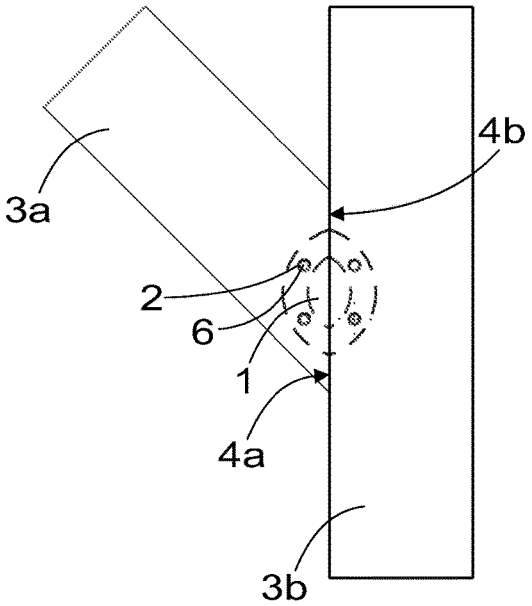

FIGS. 5*a* and 5*b* schematically show some other wood structure joints in which the first wood structure 3*a* and the second wood structure 3*b* are joined to one another by a joint structure comprising at least one joining element 1, at least one grooves 5*a*, 5*b* arranged in the first and the second wood structure, one groove in each wood structure 3*a*, 3*b* to be joined per each joining element 1 to be used in the joint structure, as well as joint pins 6 arranged in joint holes of the joining element. The structure may then also comprise a plurality of joining surfaces 4*a*, 4*b*.

In FIG. 5*a*, for example, two wood structures 3*a*, 3*b* are joined to one another by a butt joint in which an end of both wood structures is shaped such that each wood structure is provided with two joining surfaces 4*a*, 4*b* of the presently disclosed kind, and each joining surface pair is joined by using one joining element and/or method according to those disclosed in the present description for joining wood structures. In FIG. 5*b*, in turn, the wood structures 3*a*, 3*b* to be joined are joined at an angle with respect to one another and, again, one joining element and/or method according to those disclosed in the present description for joining wood structures may have been used in the joining. In still another embodiment, three or more wood structures 3*a*, 3*b* may be joined to one another by using one or more joining elements 1 and/or methods disclosed in the present description for joining wood structures.

In an embodiment, the binding agent may comprise a glue, preferably a polyurethane glue or a corresponding expanding glue, arranged in capsule form. In such a case, the binding agent may become activated only after influence is exerted on the capsule, for instance the surface of the capsule is broken, by an external object, for instance by the joining element 1 and/or the joint pin 6. In such a case, the binding agent capsule may be arranged between at least one wood structure 3*a*, 3*b* to be joined and the joining element 1, and the binding agent may be arranged to become activated and/or expand when the joining element is arranged in the space formed by the grooves 5*a*, 5*b* of the wood structures 3*a*, 3*b* to be joined and the wood structures 3*a*, 3*b* are arranged such that their joining surfaces 4*a*, 4*b* reside against one another, in which case the joining element 1 or the joint pin 6 may influence the binding agent capsule. The joining element 1 and/or the joint pin 6 may then serve as a piston, as it were, pushing the binding agent out of the capsule while the wood structures 3*a*, 3*b* and the joining element 1 press against one another.

It will be apparent to a person skilled in the art that as technology advances, the basic idea of the invention may be implemented in many different ways. The invention and its embodiments are thus not restricted to the examples described above but may vary within the scope of the claims.

The invention claimed is:

1. A joining element for joining wood structures to one another, wherein the joining element comprises at least two joint holes for pin joints as well as a first plane surface and a second plane surface, the first plane surface and the second plane surface being arranged on opposite sides of the joining element in a mutually substantially parallel manner and arranged to define a middle area of the joining element, and an inclined surface slanting towards an outer edge of the joining element and arranged at an angle with respect to at least one said plane surface, such that the joining element is tapered at least at one of its outer edges or in one area of its outer edge compared to the area of a middle part of the joining element, and wherein the joining element comprises a first curved part at a first end of the joining element and a second curved part at a second end, opposite to the first end, of the joining element.

2. The joining element as claimed in claim 1, wherein the joining element is symmetrical in cross-section such that it comprises mutually substantially parallel first and second plane surfaces as well as on both sides of the joining element, at least at the first and the second end of the joining element, inclined surfaces slanting from these plane surfaces towards the outer edge of the joining element, the joining element being at the first end and at the second end in the direction of the joint holes more tapered than in the middle area of the joining element defined by the first and the second plane surface.

3. A joint structure for joining wood structures, comprising a joining element according to claim 2.

4. The joining element as claimed in claim 1, wherein the joining element is formed from a wood material.

5. The joining element as claimed in claim 4, wherein the joining element is formed from a cross-glued wood material.

6. A joint structure for joining wood structures, comprising a joining element according to claim 1.

7. A joint structure for joining wood structures, comprising a joining element according to claim 4.

8. A joint structure for joining wood structures, comprising a joining element according to claim 5.

9. A method of joining wood structures to one another, the method comprising:

selecting a joining element according to claim 1, providing a joining surface of each wood structure to be joined with a groove such that the joining element is arrangeable in a space formed by the grooves provided in the wood structures to be joined when the wood structures are placed against one another with the joining surfaces of the wood structures facing one another, and in that the space has substantially the same size and shape as the joining element, arranging a binding agent in the groove provided in at least one wood structure to be joined, arranging the joining element in the groove of at least one wood structure to be joined, and joining the wood structures to one another with the joining surfaces facing one another, such that the joining element and the binding agent substantially fill the space up, arranging a joint pin in each joint hole of the joining element through at least one wood structure to be joined in order to lock the wood structures in place with respect to one another, and arranging the groove to be formed in each wood structure to be joined to comprise a shape substantially in conformity with that of the first or the second curved part.

10. The method as claimed in claim 9, wherein the binding agent comprises a polyurethane glue.

11. The method as claimed in claim 9, wherein the joining element is formed from a wood material.

12. The method as claimed in claim 11, wherein the joining element is formed from a cross-glued wood material.

13. The method as claimed in claim 9, wherein the joint pin is formed from the same material as at least one of the wood structures to be joined.

* * * * *